United States Patent [19]

Nouwen

[11] Patent Number: 4,616,750

[45] Date of Patent: Oct. 14, 1986

[54] CONTAINER FOR THE STORAGE OF PHOTOGRAPHIC FILMS AND THE LIKE

[76] Inventor: Bart Nouwen, Edelfalter 11, D-4044 Kaarst, Fed. Rep. of Germany

[21] Appl. No.: 595,308

[22] Filed: Mar. 30, 1984

[30] Foreign Application Priority Data

Apr. 2, 1983 [DE] Fed. Rep. of Germany ..... 3312064

[51] Int. Cl.[4] ..... B65D 85/671

[52] U.S. Cl. ..... 206/316; 206/389; 206/459; 220/23.4

[58] Field of Search ..... 206/53, 316, 689, 398, 206/407, 459, 504, 534; 220/23.4, 23.83, 23.86; 222/565

[56] References Cited

U.S. PATENT DOCUMENTS

| | | | |
|---|---|---|---|
| 1,391,772 | 9/1921 | Dunham | 222/565 |
| 1,714,368 | 5/1929 | Hobson | 222/565 |
| 2,077,219 | 4/1937 | Conner | 215/6 |
| 2,233,614 | 3/1941 | Krotoschiner | 206/459 |
| 2,636,633 | 4/1953 | Carlson | 220/23.4 |
| 2,817,451 | 12/1957 | Giles et al. | 215/230 |
| 3,073,468 | 1/1963 | Arneson | 215/230 |
| 3,151,599 | 10/1964 | Livingston | 215/230 |
| 3,355,061 | 11/1967 | Ritter | 206/389 |
| 3,482,681 | 12/1969 | Nerwin et al. | 206/459 |
| 3,766,882 | 10/1973 | Babbitt | 215/230 |
| 4,078,686 | 3/1978 | Karesh | 215/6 |
| 4,189,057 | 2/1980 | Morille | 220/23.4 |

FOREIGN PATENT DOCUMENTS

| | | | |
|---|---|---|---|
| 1259532 | 1/1968 | Fed. Rep. of Germany | 220/23.4 |
| 0856044 | 3/1940 | France | 206/459 |
| 1453638 | 9/1966 | France | 220/23.4 |
| 1544144 | 10/1968 | France | 220/23.4 |
| 0846602 | 8/1960 | United Kingdom | 220/23.4 |

*Primary Examiner*—William Price
*Assistant Examiner*—Jimmy G. Foster
*Attorney, Agent, or Firm*—Andrus, Sceales, Starke & Sawall

[57] ABSTRACT

A container for the storage of photographic film materials has a container body possessing, at oppositely lying positions of its peripheral surface, projecting locking sections with which suitably formed locking sections of a coupling element are bringable into engagement so that, two containers are assemblable into a unit. On the cover of the container a rotatable indicator is provided to indicate whether the container is empty or contains exposed or unexposed film.

19 Claims, 7 Drawing Figures

Section A-A

Figure 1:
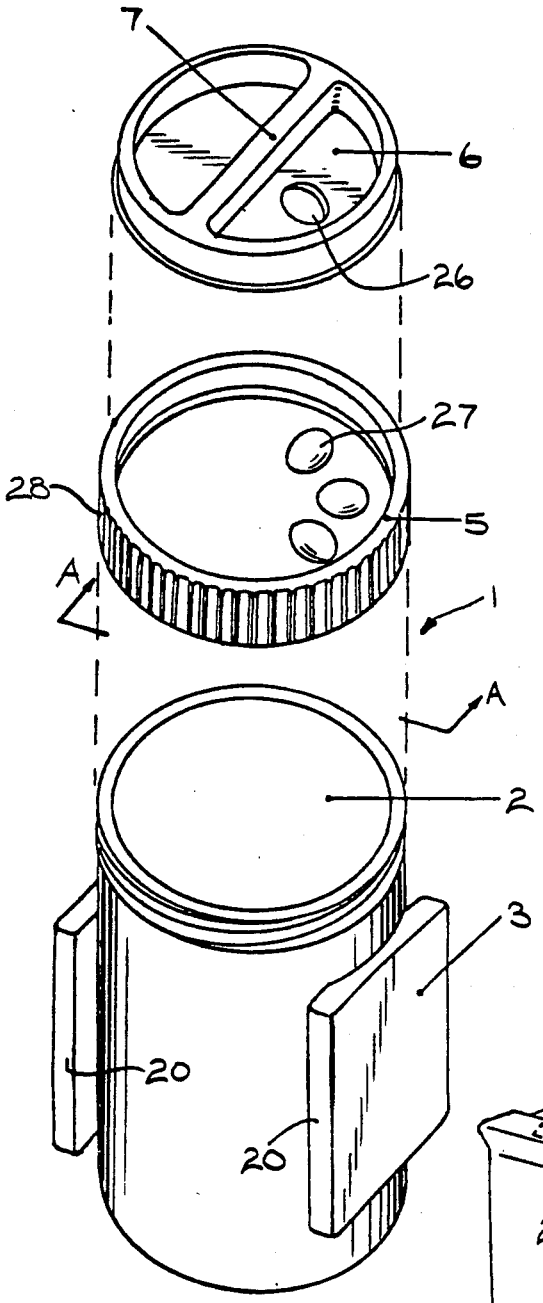

Fig. 4
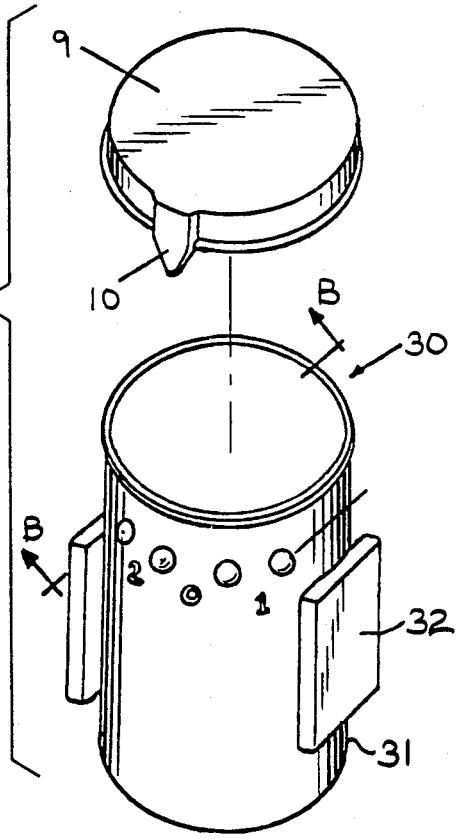
Fig. 6
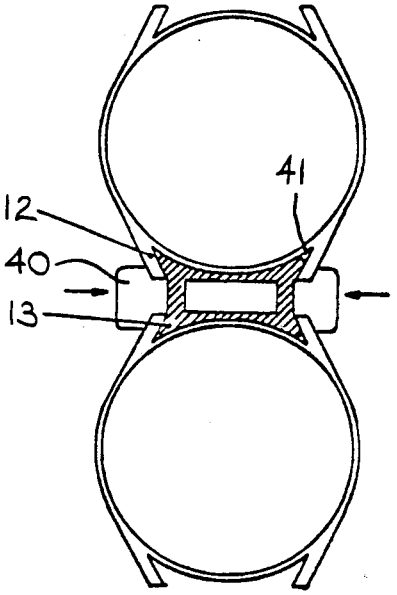
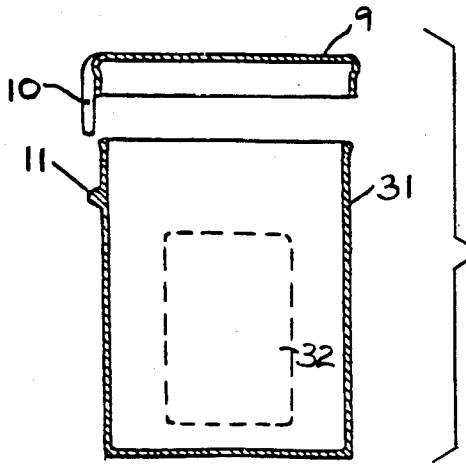
Fig. 5
Section B-B

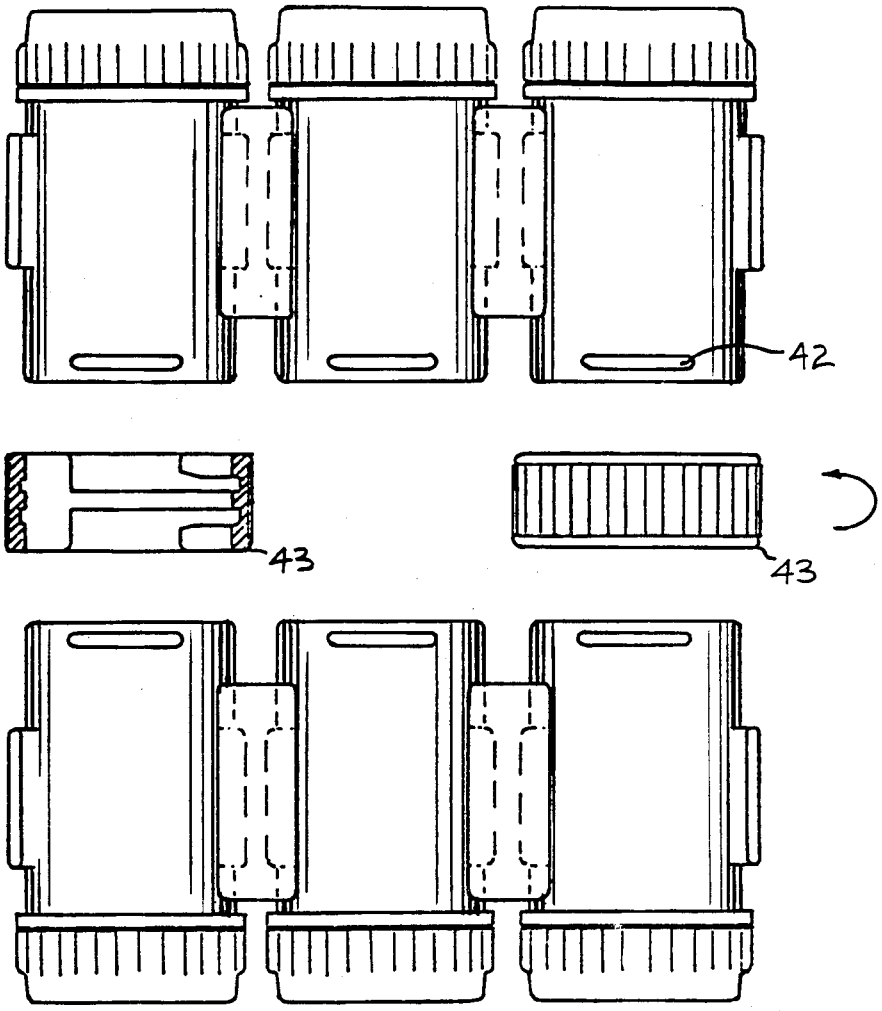
Fig. 7
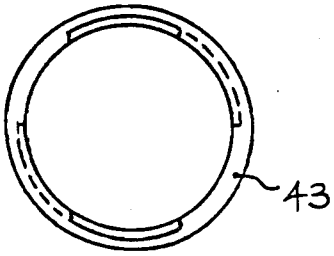

CONTAINER FOR THE STORAGE OF PHOTOGRAPHIC FILMS AND THE LIKE

The present invention relates to a container for the storage of photographic films, film cartridges, film spools, and the like with a hollow cylindrical container body and a container cap sealable with the container body that is formed as a threaded and/or press cap.

The commercial photographic films are today available, as a rule, in cartridges that are offered for sale in corresponding packages. If a number of films are needed, for example, for a vacation trip or the like, the film cartridges must be transported, with or without packaging, loose in pockets, purses, suitcases, etc. This is very uncomfortable and there exists the danger, that the film can relatively easily go astray.

Further, this type of storage or transport has the disadvantage that confusion can come up between already exposed film and unexposed films. This is particularly the case, if the film cartridges have already been taken out of their packaging. In order to avoid this, of course, markings or legends can be provided. These represent, however, a considerable additional expense.

The object of the present invention is to provide a container for the storage of photographic films that can be assembled into comfortable, manipulatable, elements formed out of a plurality of containers and simultaneously makes possible an indication of their therein contained films.

This object is achieved with a container of the initially described type in that the container body possesses, at oppositely lying positions of its peripheral surface, projecting locking sections with which suitable formed locking sections of a coupling element are bringable into engagement so that, respectively, two containers are assemblable into a unit, and that on the cover of the container a rotatable indicator is provided.

The gist of the present invention is therefore to fasten together a plurality of containers through a corresponding number of coupling elements into a larger unit, that is far more convenient for the storage and transport than the individual film cartridges. With different types of containers and coupling elements, individually desired elements can be assembled that can also be put, without more, in the pockets of clothing, so as, for example, to avoid X-ray examinations at airports of films transported in traveling baggage.

The containers formed according to the invention are proportioned in their size to the commercial film cartridges. They are provided either with a screw cap or with a press cap, which however should not exclude other cap constructions. In order to make possible an indication of the film stored in the containers of the assembled elements, a rotatable indicator is provided on the respective container cover, that can be manually brought into a desired position that indicates the condition of the stored film-for example exposed or unexposed. Without this indicator a knowledge of the stored film cartridges or a difference between exposed or unexposed films would be possible only with difficulty, since the film cartridges are removed from their packaging for storage. The indicator can also show if the container is not filled.

The containers constructed according to the invention are preferably manufactured from plastic, that possesses a predetermined elastic property, so that a locking connection can be produced between the locking sections provided on the outer surface of the container body and on the coupling element. In this connection, suitable plastics are known to those skilled in the art. The locking sections are preferably arranged at two oppositely lying positions on the peripheral surface of the container body so that a plurality of containers can be assembled in a row.

A further exemplary embodiment is so characterized in that the container body possesses two, respectively opposite lying corresponding locking sections at four places on its periphery. With this embodiment units can be assembled in two directions extending normal to each other.

For this purpose, the locking sections exhibit a ridge-like form and are so arranged that they extend parallel to the longitudinal axis of the container. They will thus insert in corresponding grooves of the coupling element or, projecting locking sections of the coupling element will so be brought in engagement with the locking sections of the container body, that they reach behind the ridges. In order to insure the retention of the containers in or on the coupling element, protruding elements, for example transverse bars, are provided either on the coupling element or on the container body that form the termination of the mounting grooves. When the corresponding locking sections are introduced in the mounting grooves, these protruding element prevent a removal. With these it is thus possible that through manual action on the coupling element, for example pressing apart or together, a separation of the locking sections from the projections locking in the locking grooves can be achieved.

In order to secure a reliable connection between the individual containers, the coupling element is preferably plate formed and coacts at a side of the container body with two locking sections, which can comprise, for example, end sections of an integral coupling plate projecting from the container outer surface or can comprise two ridge formed locking sections. With this exemplary embodiment, two pairs of locking sections enter in engagement with each other at a coupling position. Thus at two positions of the container outer surface, a connection is produced, so that an altogether stiffer element can be produced than if only one engagement point was provided. Special constructions of this type are disclosed in the following description of the exemplary embodiments. They have the advantage that, in addition to the engagement of the locking sections, a surface contact between the container body outer surface and the coupling element can be provided, so that a very stable connection results. For this the corresponding surfaces of the coupling elements are provided with the same bending radius as the container body outer surfaces, so that the surfaces can lie close to each other. In order to make possible a loosening of the parts from each other, preferably lateral gripping sections are provided that make possible a pulling apart or pushing together of the coupling elements.

Figure 2:
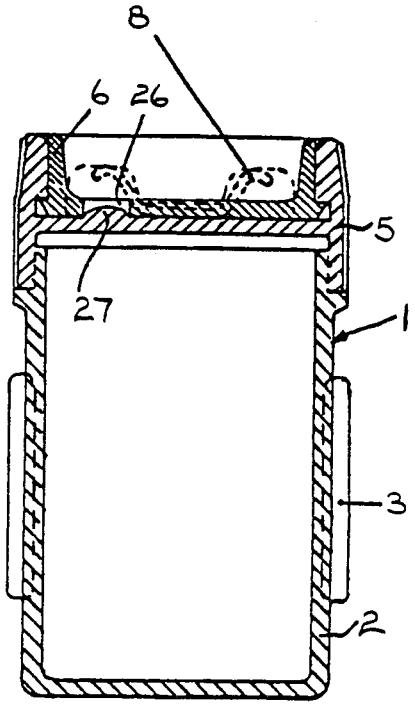
Figure 3:
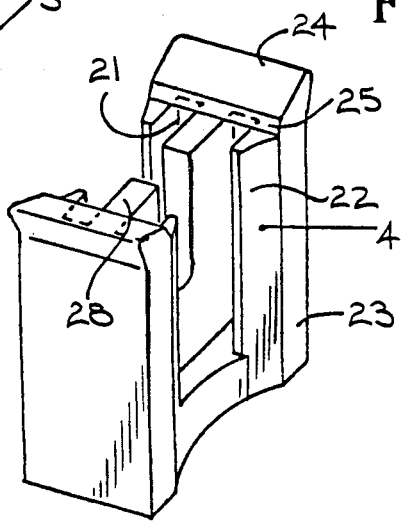

Further embodiments of the inventive subject matter appear in the dependent claims. The invention is further explained, in detail, by means of three exemplary embodiments in connection with the drawing. Thus, completely described and representative parts can be ascribed the meaning essential to the invention. The drawings show:

FIG. 1, in perspective view, a container for the storage of photographic films with the cover and indicator removed;

FIG. 2, a section through the container of FIG. 1 along the line A—A;

FIG. 3, an associated coupling element in perspective view;

FIG. 4, a perspective view of a further embodiment of the container with the cover removed;

FIG. 5, a section through the container of FIG. 4 along the line B—B in FIG. 4;

FIG. 6, a horizontal section through a third embodiment of an assembled unit of two containers and a coupling element; and FIG. 7, a plurality of assembled containers that are additionally provided with locking sections, through which they are coupleable to each other by an additional coupling element, whereby the additional coupling element is shown in side view, plan view, and in section.

FIG. 1 shows a container 1 for the storage of photographic films, film cartridges, film spools, and the like formed of three parts. Included in the three parts is a container body 2 in the form of a hollow cylinder, that is provided with a thread on its upper rim, a screw cap 5 with which the container body is closed, and a indicator 6 insertable on the cover. At two oppositely lying positions on its outer peripheral surface, the container body has two coupling plates 3 integrally formed with it, that extend somewhat tangentially to the container body outer surface. The coupling plates 3 possess end sections 20, that project from the container body outer surface. With these end sections, there results an engagement with a coupling element 4 shown in FIG. 3.

The container cover 5 is provided with a ribbed rim 28 so that it can be easily screwed on and screwed off. Behind the rim is located a depression in which an indicator 6, adapted to the form of the cap, is rotatably supported. The indicator 6 has a transverse web 7 with which the indicator can be rotated relative to the cover. On the underside of the indicator an opening 26 is provided, that through rotation can be brought into coaction with corresponding arched sections of the cover upper surface. On the basis of the arching of the sections 27 the opening locks when it arrives in engagement with the arched section. With the illustrated exemplary embodiment three arched sections 27 are provided.

FIG. 2 shows a section through the container along the line A—A in FIG. 1 with the cover and the therein arranged indicator screwed on. As one can appreciate from FIG. 2, the indicator 6 formed as a disc undercuts the cover rim 28 from the inside so that it is secured against falling out. The indicator can lock in three positions as the entire container is produced out of a suitable elastic plastic. This locking action is, however, increased in that in the transverse web 7 serving as a grip bar, a spring steel element 8 is imbedded. Thus with the transport of the container, an unintentional rotation is impeded.

When the container is assembled as shown in FIG. 2, it is assembled by means of the coupling element 4 shown in FIG. 3 into a unit formed of a plurality of containers. Thus, the coupling element 4, that is generally in a U-form and possesses, on its interior, mounting grooves 21 for the projecting coupling plate end section 20 of the container, is slid from below to above on the coupling plate 3 so that the end sections of the coupling plates engage in the mounting grooves 21. When the end sections are arranged completely in the mounting grooves, a transverse bar 25 covering the mounting groove that has been compressed with the insertion protrudes, and in that manner locks in the pate 3 in the coupling element. The coupling element is symmetrically formed so that in the adjacent mounting groove the coupling plate of an additional container can be inserted.

With the thus illustrated embodiment, the outer bordering strips 22, as well as the lower part of the coupling element are accommodated in the curve of the outer surface of the container body, so that in the inserted condition of the coupling plate 3, the coupling element lies with these sections on the container body outer surface. In this manner a stable connection is insured. On the upper end of the side piece 23 of the coupling element is located grip bars 24, that can be pressed apart in order to again loosen the coupling element from the container. Thus the transverse bar 25 falls out of engagement with the coupling plate 3, so that the container can be further drawn out of the mounting grooves 21. Between the mounting grooves 21 is located a separting strip 28 opposite the outer strips 22 formed somewhat thicker and larger for stabilization.

The containers can be filled both in the individual condition as well as also in the transporting unit formed out of a plurality of containers. The connection formed through the coupling elements is so stable that it permits, without more, screwing the container cover on and off. When a container is filled with an unexposed or exposed film cartridge, the indicator 6 is rotated by means of the transverse web 7 in the corresponding position, that indicates the condition of the film (exposed or unexposed). These positions are prescribed in the cover through the respective arched sections 27, with which the opening 26 in the indicator is brought in engagement. With the exemplary embodiment, three arched section 27 are provided, that can indicate the empty condition of the container, and an unexposed film, or an exposed film.

In FIGS. 4 and 5 a further embodiment of a container for the storing of photographic film is shown. The container 30 is again formed out of a hollow cylindrical container body 31, which is closeable with a cover 9. The cover is, however with this embodiment, not formed as a screw cover but rather as a press cover, which is insertable over the edge of the container body. In order to guarantee a secure attachment of the cover, the upper edge of the container body is formed somewhat thickened and engages a depression in the inside of the cover, as is shown in FIG. 5.

With this embodiment, the elements serving for the connection of a plurality of containers are to resemble the embodiment of FIGS. 1 through 3, so that details need not further be gone into. The indicator is simply formed.

As one can appreciate from FIG. 4, the container cover 9 is, itself, formed as the indicator and has a pointer 10, which, through rotation of the cover, can be brought into different positions on the container body. In order to secure these positions, lifting cams 11 are provided, between which the indicator 10 can lock. Three positions are here also again provided, that indicate the empty condition of the cassette, the storage of an unexposed film, and the storage of an exposed film.

Finally, an embodiment of a container and a coupling element is shown in FIG. 6, that departs from the previously described embodiments. With this embodiment the container possesses no coupling plates, but rather two pair of locking ridges 12, that are gripped behind by the coupling element 13. The coupling element 13 is so formed that it comes into abutment on the container body outer surface with its oppositely lying surfaces. Thus the coupling element is inserted from below in the locking grooves 41 formed between the ridges 12 and the container outer surface. In order to prevent an upwardly sliding out, a stop in the form of a suitable transverse bar can be provided with this embodiment. For removal of the coupling element from the container with this embodiment, two lateral gripping sections 40 must be compressed that effect a deformation of the coupling element on the basis of its hollow configuration and thus a loosening of the locking connection.

FIG. 7 shows an embodiment of a container that is provided with two additional radially opposed locking sections 42 on the exterior in the area of the base. With these locking sections, the container can be assembled on the bottom side with a further container. An additional coupling element serves for this purpose that is formed in the shape of a coupling ring 43. With assembly, the containers are inserted in the coupling ring from opposite ends, so that the locking sections 42 of the containers pass in the inner lying entry section of the coupling ring. Through a rotation of the containers and/or the coupling ring the locking sections are transported out of the entry section into the holding section, in which they lock. When the containers are to be separated a reverse rotary movement occurs.

With the last described embodiment, the containers can thus also be coupled together on the end side as well as the base side so that a compact arrangement of the containers can be achieved as illustrated in the exemplary embodiment in FIG. 7.

In order to protect the film stored in the containers against X-ray examination in airports, the containers can be coated with lead in the interior. Suitable injection techniques for the application of the lead on the inside of the containers are known.

I claim:

1. A container assemblage for the storage of photographic films, film cartridges, film spools and the like comprising:

a pair of hollow cylindrical container bodies suitable for receiving films, cartridges or spools, said container having, on diametrically oppositely lying positions on its outer surface, projecting locking members;

a coupling element interposable between said container bodies for engaging said locking members, said coupling element arranging said container bodies along a common diametral line with which coupling element lying between the container bodies on said diametral line;

each of said projecting locking members of said container bodies comprising a pair of locking sections engageable with a mating pair of locking sections of said coupling element, said locking sections of said container bodies and coupling element being spaced from each other in a direction normal to said diametral line, said locking sections on said container bodies comprising a circumferentially spaced pair of ridges (12) projecting from the outer surface of said container bodies for forming locking grooves (41) between said ridges and the container body outer surface, said locking grooves formed between said ridges and said container body outer surface subtending acute angles, said coupling element having mating corners (13) insertable in said grooves; and a container cover for each of said bodies, said cover being sealable to the respective container body, said cover having a rotatable indicator for indicating the condition of the contents of said container body.

2. The container assemblage according to claim 1 characterized in that said locking members extend parallel to the longitudinal axes of said container bodies.

3. The container assemblage according to claim 1 wherein said locking grooves are closed at the upper ends.

4. The container assemblage according to claim 1 wherein said coupling element is formed as a hollow box-like member having acutely formed corners insertable in said locking grooves (41).

5. The container assemblage according to claim 1 wherein said coupling element is formed of a hand deformable material and is further defined as having lateral gripping sections (40) for deforming said coupling element to separate said coupling element and container bodies.

6. The container assemblage according to claim 1 wherein said container bodies have outer cylindrical surfaces and wherein the portions of said coupling element abutting said container bodies are curved into conformity with the outer cylindrical surface of said container bodies to lie along said outer surfaces.

7. The container assemblage according to claim 1 wherein said container bodies have bases and are provided with additional locking sections (42) on their outer surfaces adjacent said bases and wherein said assemblage further includes a second coupling element comprising a coupling ring (43) positionable over the bases of two container bodies and engageable with said locking sections (42) for joining two containers together in a base-to-base configuration.

8. The container assemblage according to claim 1 wherein said rotatable indicator is formed as a rotatable disc arranged on said cover (5), said disc having an opening (26) cooperable with a plurality of arcuately spaced, convexly curved sections (27) arranged on said cover for providing an indication of the condition of the contents of said container body.

9. The container assemblage according to claim 1 wherein said container cover is further defined as a press cap and wherein said indicator is further defined as a peripherally dependent indicator (10) movable along the peripheral surface of said container body and wherein said container body has a plurality of cams (11) on the peripheral surface thereof for embracing said peripherally dependent indicator (10).

10. The container assemblage according to claim 1 wherein said container assemblage is formed of an elastic plastic material.

11. A container assemblage for the storage of photographic films, film cartridges, film spools and the like comprising:

a pair of hollow cylindrical container bodies suitable for receiving films, cartridges or spools, each said container body having, on diametrically oppositely lying positions on its outer surface, projecting locking members, said container bodies having outer cylindrical surfaces, said locking members comprising plate-like members having end regions (20), said plate-like members being tangentially applied to the outer cylindrical surfaces of each of said container bodies, said end regions extending tangentially beyond the points of application of said plate-like members to said outer cylindrical surfaces of said container bodies;

a coupling element interposable between said container element bodies for engaging said locking members, said coupling element including means for forming slots (21) for receiving said end regions (20), said coupling element arranging said container bodies along a common diametral line with said coupling element lying between the container bodies on said diametral line; and a container cover for each of said bodies, said cover being sealable to the respective container body, said cover having a rotatable indicator for indicating the condition of the contents of said container body.

12. The container assemblage according to claim 11 wherein said coupling element is essentially U-shaped in crosssectional configuration and has a pair of spaced side elements (23) with inwardly projecting flanges (22, 28) for forming two mounting slots (22) for the end regions (20) of said locking members.

13. The container assemblage according to claim 12 wherein said coupling element is formed of deformable material and further includes a transverse bar (25) extending across the upper ends of said side elements and mounting grooves for locking said plate end regions (20) in said grooves.

14. The container assemblage according to claim 12 wherein said coupling element is formed of a hand deformable material and has outwardly projecting gripping section (24) on the upper ends of said side members (23) for deforming said coupling element to permit removal of said end regions (20) from said slots (21).

15. The container assemblage according to claim 11 wherein the portions of said coupling element abutting said container bodies are curved into conformity with the outer cylindrical surfaces of said container bodies to lie along said outer surfaces.

16. The container assemblage according to claim 11 wherein said container bodies have bases and are provided with additional locking sections (42) on their outer surfaces adjacent said bases and wherein said assemblage further includes a second coupling element comprising a coupling ring (43) positionable over the bases of two container bodies and engageable with said locking sections (42) for joining two containers together in a base-to-base configuration.

17. The container assemblage according to claim 11 wherein said rotatable indicator is formed as a rotatable disc arranged on said cover (5), said disc having an opening (26) cooperable with a plurality of arcuately spaced,convexly curved sections (27) arranged on said cover for providing an indication of the condition of the contents of said container body.

18. The container assemblage according to claim 11 wherein said container cover is further defined as a press cap and wherein said indicator is further defined as a peripherally dependent indicator (10) movable along the peripheral surface of said container body and wherein said container body has a plurality of cams (11) on the peripheral surface thereof for embracing said peripherally dependent indicator (10).

19. The container assemblage according to claim 11 wherein said container assemblage is formed of an elastic plastic material.

* * * * *